US010454206B2

(12) United States Patent
Zhao

(10) Patent No.: US 10,454,206 B2
(45) Date of Patent: Oct. 22, 2019

(54) ELECTRICAL CONNECTOR HAVING A SHIELDING SHELL WITH A RIVETED JOINT

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/996,089

(22) Filed: Jun. 1, 2018

(65) Prior Publication Data

US 2018/0351287 A1 Dec. 6, 2018

(30) Foreign Application Priority Data

Jun. 2, 2017 (CN) ..... 2017 1 0406541

(51) Int. Cl.

| | |
|---|---|
| ***H01R 13/52*** | (2006.01) |
| ***H01R 33/965*** | (2006.01) |
| ***H01R 43/24*** | (2006.01) |
| ***H01R 13/6582*** | (2011.01) |
| ***H01R 13/6581*** | (2011.01) |
| ***H01R 43/00*** | (2006.01) |
| *H01R 24/62* | (2011.01) |
| *H01R 24/60* | (2011.01) |

(52) U.S. Cl.

CPC ..... *H01R 13/5219* (2013.01); *H01R 13/52* (2013.01); *H01R 13/6581* (2013.01); *H01R 13/6582* (2013.01); *H01R 33/965* (2013.01); *H01R 43/005* (2013.01); *H01R 43/24* (2013.01); *H01R 13/5216* (2013.01); *H01R 24/60* (2013.01); *H01R 24/62* (2013.01)

(58) Field of Classification Search

CPC ..... H01R 13/5202; H01R 13/5219; H01R 13/52; F16B 19/086

USPC ..... 439/587

See application file for complete search history.

(56) References Cited

U.S. PATENT DOCUMENTS

| | | | | |
|---|---|---|---|---|
| 5,433,500 | A * | 7/1995 | Brorson | B60P 3/32 296/100.02 |
| 8,388,380 | B1 * | 3/2013 | Van der Steen | H01R 13/5202 439/607.36 |
| 9,429,360 | B2 * | 8/2016 | Hsiao | F26B 3/28 |
| 9,461,413 | B2 * | 10/2016 | Duan | H01R 13/6594 |
| 9,647,369 | B2 * | 5/2017 | Tsai | H01R 4/02 |

(Continued)

FOREIGN PATENT DOCUMENTS

TW M518834 3/2016

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

An electrical connector includes an insulative housing, a number of conductive terminals affixed to the insulative housing and a shielding shell enclosing the insulative housing for forming a receiving room. The insulative housing includes a base portion and a tongue portion extending forwardly from the base portion. The shielding shell includes an annular wall having a riveted joint. The riveted joint is composed of a first inclining surface and a second inclining surface disposed in a thickness direction of the shielding shell.

12 Claims, 10 Drawing Sheets

(56) References Cited

U.S. PATENT DOCUMENTS

| | | | | |
|---|---|---|---|---|
| 9,728,916 | B1 * | 8/2017 | Tsai | H01R 24/60 |
| 2012/0315779 | A1 * | 12/2012 | Yudate | H01R 12/724 439/271 |
| 2014/0302709 | A1 * | 10/2014 | Zhao | H01R 12/57 439/519 |
| 2015/0087165 | A1 * | 3/2015 | Yu | H01R 12/724 439/78 |
| 2016/0020549 | A1 * | 1/2016 | Chen | H01R 13/5219 439/78 |
| 2016/0033198 | A1 * | 2/2016 | Hsiao | F26B 3/28 439/485 |
| 2016/0093974 | A1 * | 3/2016 | Lai | H01R 13/5202 439/736 |
| 2016/0104957 | A1 * | 4/2016 | Kim | H01R 13/5219 439/78 |
| 2016/0141792 | A1 * | 5/2016 | Zhao | H01R 13/6581 439/78 |
| 2016/0149337 | A1 * | 5/2016 | Ozaki | H01R 13/5219 439/529 |
| 2016/0294102 | A1 * | 10/2016 | Zhao | H01R 13/6581 |
| 2016/0352041 | A1 * | 12/2016 | Yao | H01R 13/405 |
| 2017/0047687 | A1 * | 2/2017 | Yao | H01R 12/724 |
| 2017/0054246 | A1 * | 2/2017 | Yao | H01R 13/521 |

* cited by examiner

ELECTRICAL CONNECTOR HAVING A SHIELDING SHELL WITH A RIVETED JOINT

BACKGROUND OF THE DISCLOSURE

1. Field of the Disclosure

The present disclosure relates to an electrical connector, and more particularly to an electrical connector for waterproof.

2. Description of Related Arts

Taiwan Utility Model No. 518834 discloses an electrical connector including an insulative housing, a number of conductive terminals affixed to the insulative housing, and a shielding shell. The shielding shell is formed by metal stamping and formed into a cylindrical shape by riveting. The seam formed by the shielding shell are vertically arranged such that waterproof effect is not good.

An improved electrical connector is desired.

SUMMARY OF THE DISCLOSURE

Accordingly, an object of the present disclosure is to provide an electrical connector for waterproof.

To achieve the above object, an electrical connector includes an insulative housing, a number of conductive terminal affixed to the insulative housing and a shielding shell enclosing the insulative housing for forming a receiving room. The insulative housing includes a base portion and a tongue portion extending forwardly from the base portion. The shielding shell includes an annular wall having a riveted joint. The riveted joint is composed of a first inclining surface and a second inclining surface disposed in a thickness direction of the shielding shell. In the present invention, the riveted joint is designed to be obliquely arranged at the shielding shell, so that the first inclining surface and the second inclining surface forming the riveted joint has a large contact area. When the shielding shell is riveted, the two are in contact with each other. Larger and easier to fit. Due to the overlapped part of the upper and lower shielding shell during riveting, the gap of the shielding shell after riveting can be made smaller, and the waterproof effect is good.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
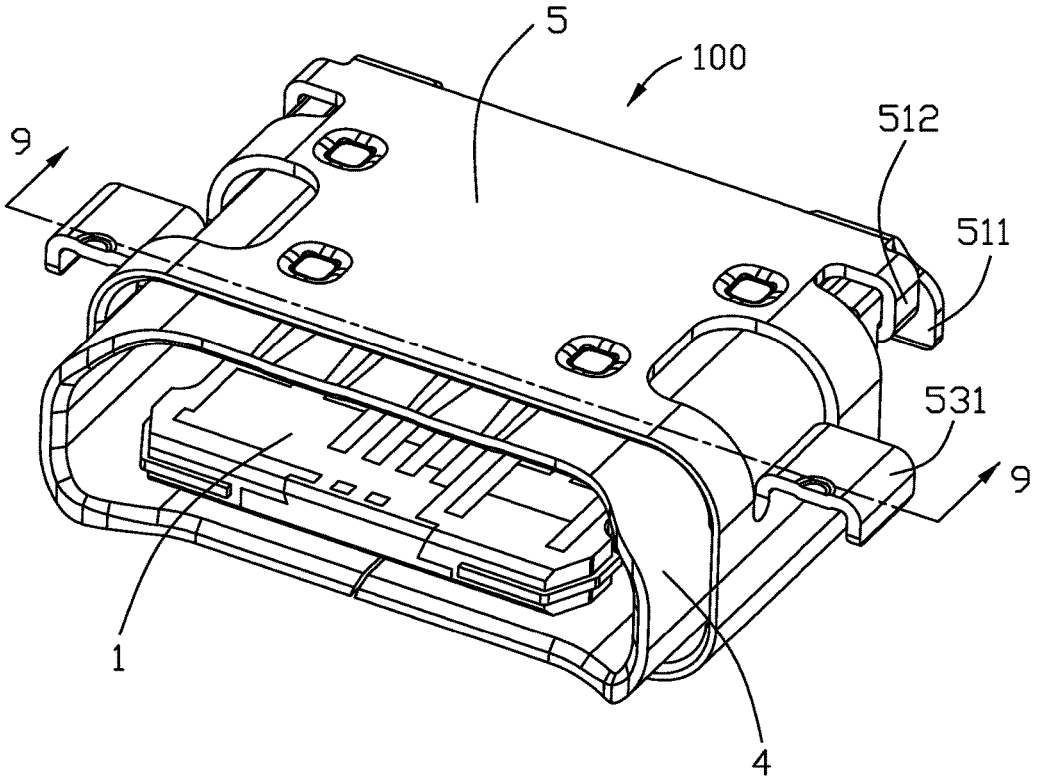
FIG. 1 is a perspective, assembled view of an electrical connector.

Reference will now be made in detail to the embodiments of the present disclosure. The embodiment will be shown in FIGS. 1 to 9. The insert direction of the electrical connector 100 is a front-to-rear direction.

Referring to FIGS. 1 to 9, the electrical connector 100 includes a contact module, a shielding shell 4 enclosing the contact module and having a receiving room 10, an outer shell 5 attached to the shielding shell 4 and a sealer 6 sealing an rear end of the electrical connector.

Referring to FIGS. 4 to 7, the contact module includes an insulative housing 1, a number of conductive terminals 2 affixed to the insulative housing 1 and a shielding plate 3 affixed to the insulative housing 1. The insulative housing 1 includes a base portion 11 affixed to the receiving room 10 and a tongue portion 12 extending forwardly from the base portion 11 and forming a mating room 40 with the shielding shell 4. The base portion 11 includes a pair of resisting grooves 111 in symmetry located at a front end, a sol 112 located at an rear end, and a mounting portion 113 protruding upwardly and laterally from the sol 112. The sol 112 includes an rear surface 1121 located at a same plane with an rear surface of the sealer 6. The mounting portion 113 includes a front surface 1133 protruding upwardly and laterally from the sol 112, a pair of buckling portions 1131 located downwardly and an rear buckling surface 1132 perpendicular to the buckling portions 1131. The tongue portion 12 includes a stepped portion 121 abutting with the base portion 11 and a flat portion 122 extending forwardly from the stepped portion 121 and having a thinner thickness than that of the stepped portion 121. The flat portion 122 includes a pair of mating grooves 1221 located laterally and connecting with a mating electrical connector. The insulative housing 1 further includes an insulator 13 located at a front end.

Figure 6:
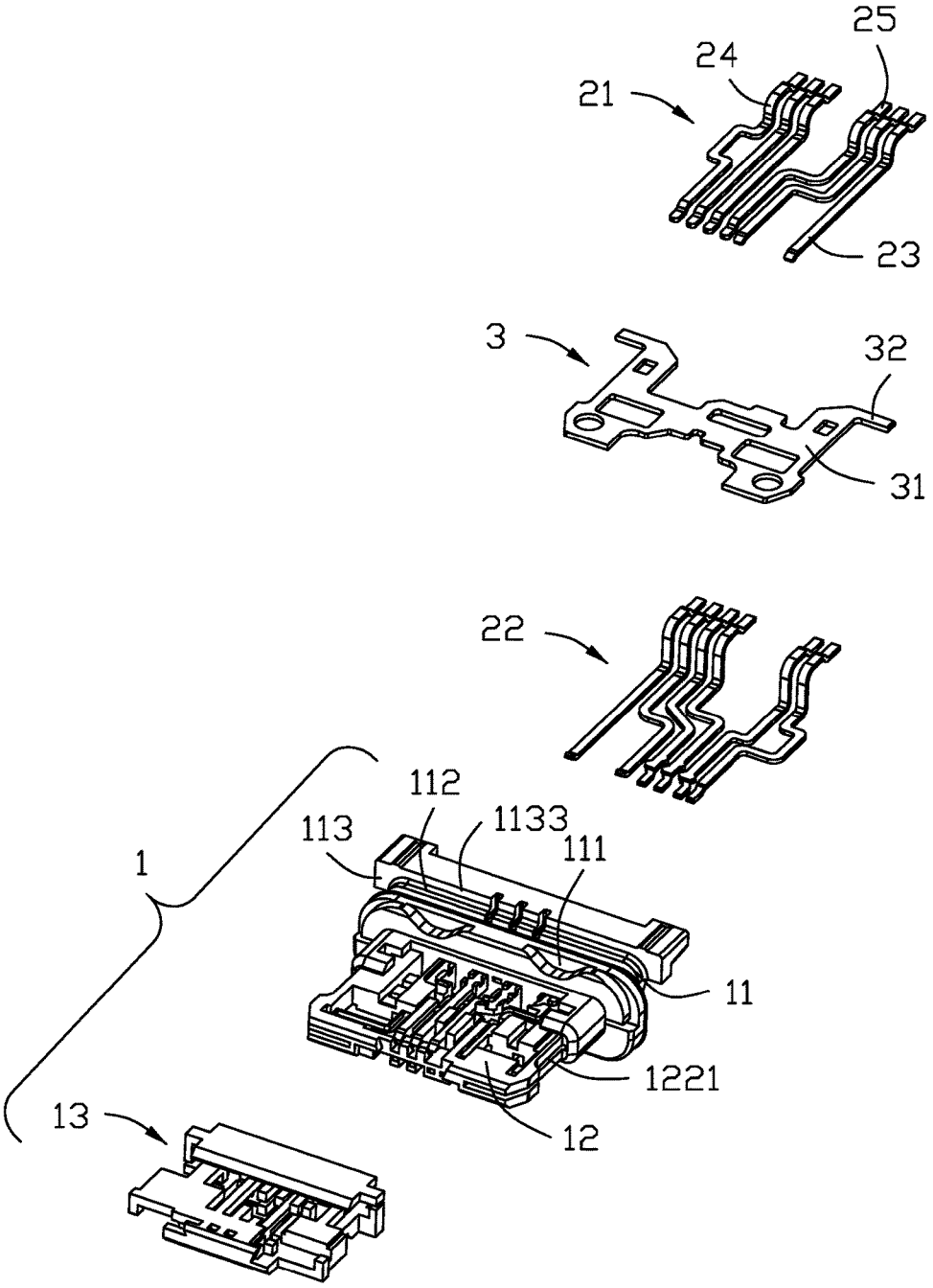
FIG. 6 is an exploded view of a contact module of the electrical connector.
Figure 7:
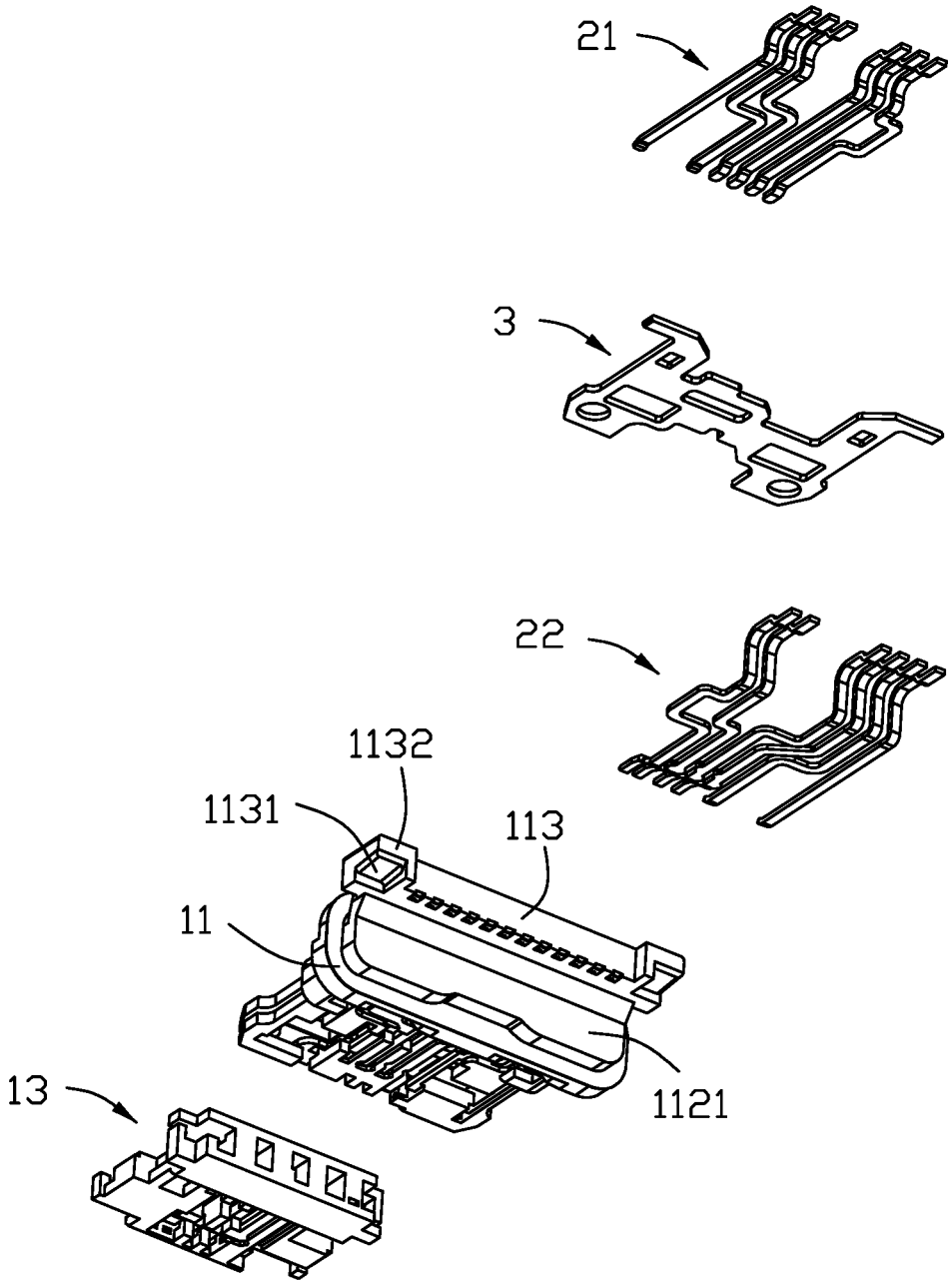
FIG. 7 is another exploded view of the contact module taken from FIG. 6.
Figure 8:
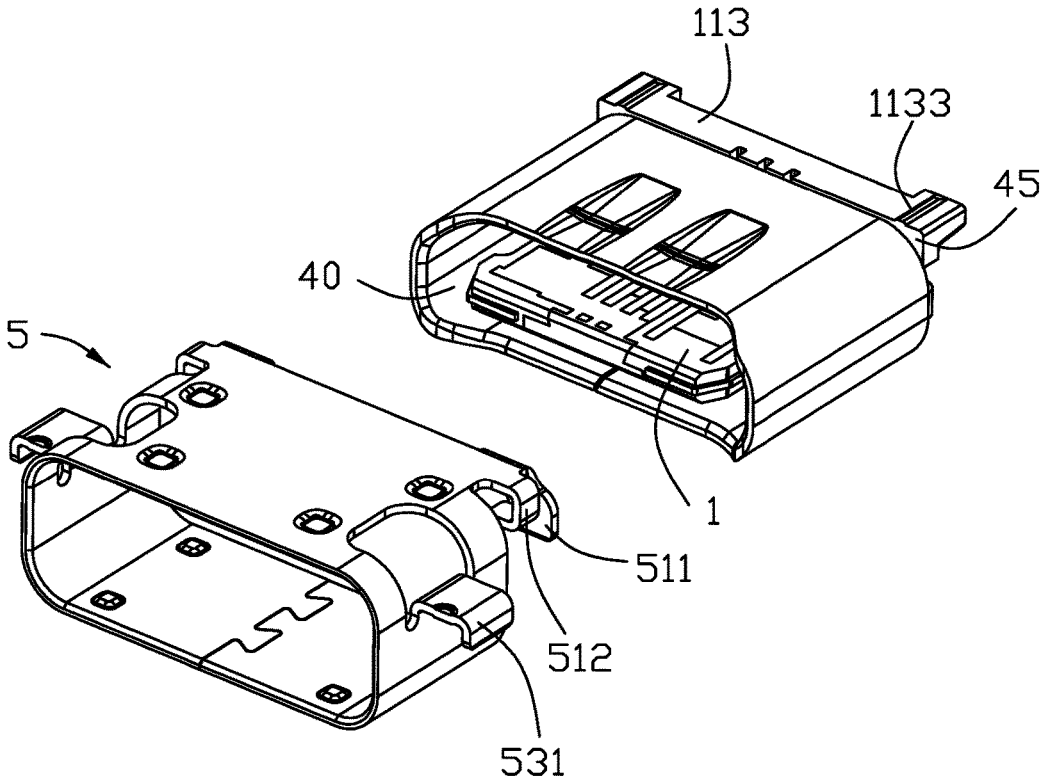
FIG. 8 is a partial view of the electrical connector.
Figure 9:
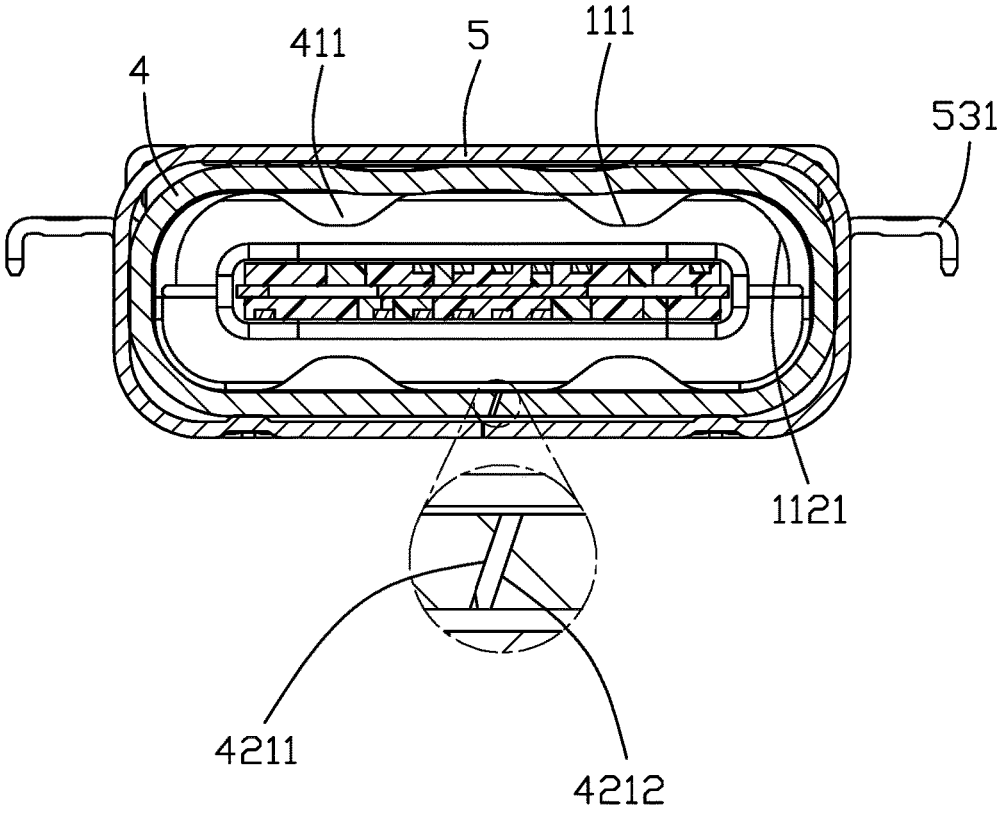
FIG. 9 is a cross-sectional view of the electrical connector taken along line 9-9 in FIG. 1.

Referring to FIGS. 6-7 and 9, the conductive terminals 2 include a number of upper terminals 21 and lower terminals 22. Each conductive terminal 2 includes a contacting portion 23 exposed to the tongue portion 12, a fixed portion 24 affixed to the base portion, and a soldering portion 25 extending rearward from the fixed portion 24. The soldering portions 25 of the upper terminals 21 and the soldering portions 25 of the lower terminals 22 are in the same plane.

The shielding plate 3 is sandwiched between the upper terminals 21 and the lower terminals 22. The shielding plate 3 includes a main portion 31 sandwiched between the upper terminals 21 and the lower terminals 22 and a pair of soldering pins 32 bending rearward and then laterally.

Figure 2:
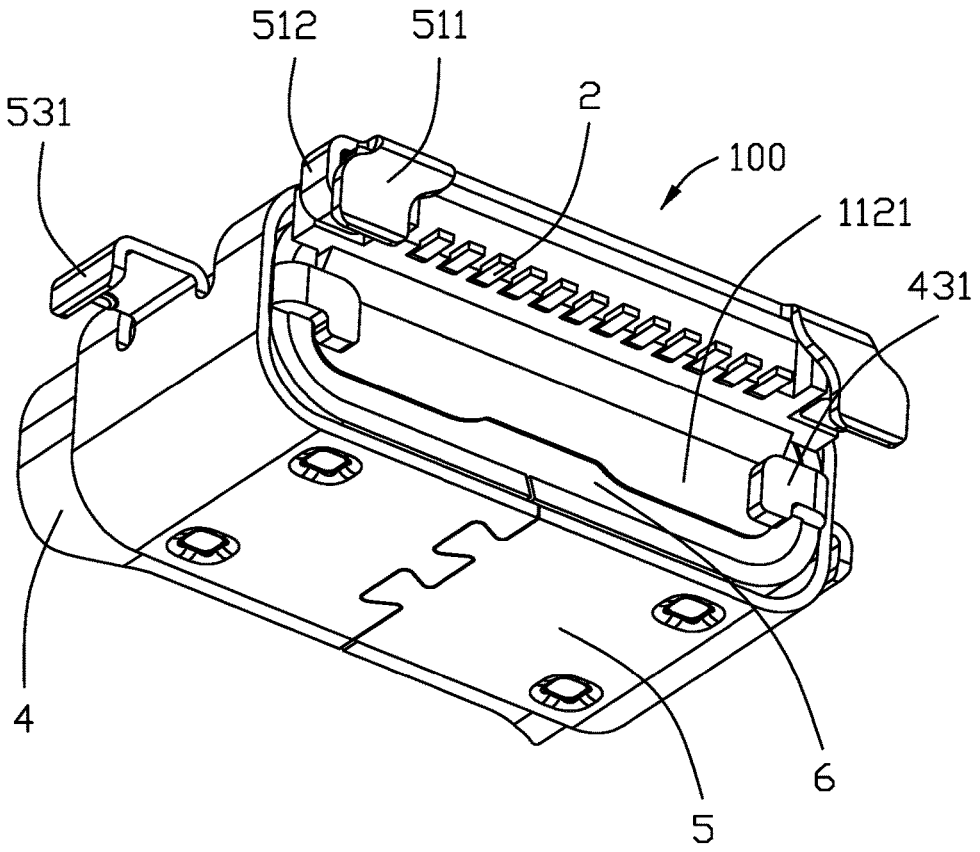
FIG. 2 is another perspective, assembled view of the electrical connector taken from FIG. 1.
Figure 3:
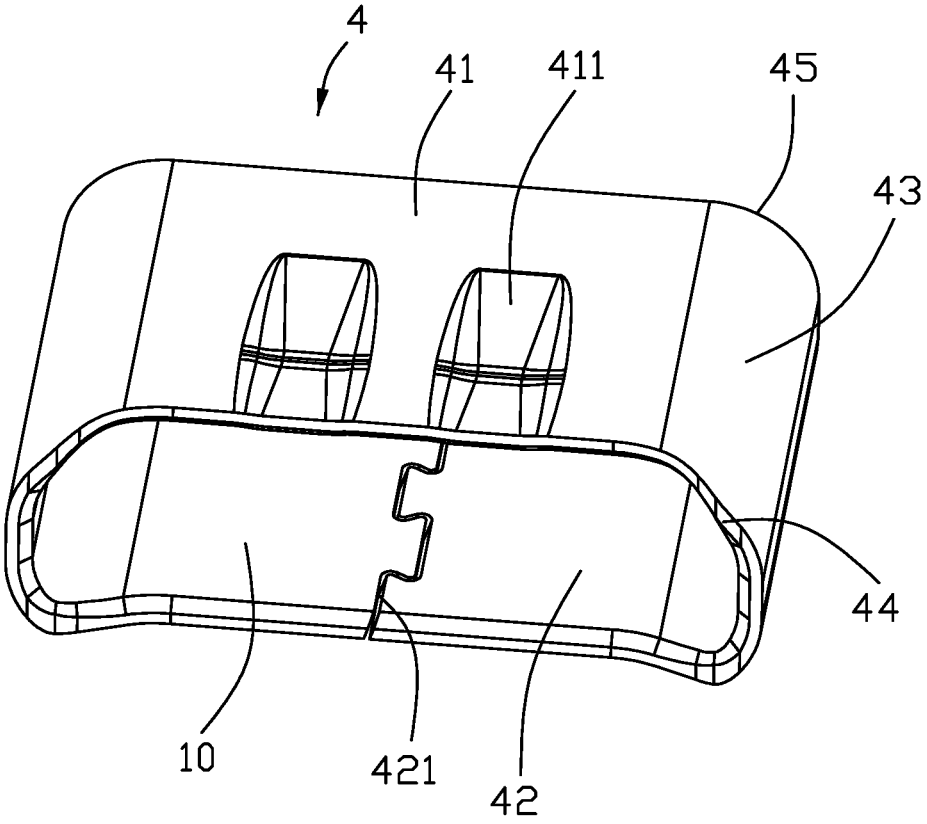
FIG. 3 is a perspective view of a shielding shell of the electrical connector.
Figure 4:
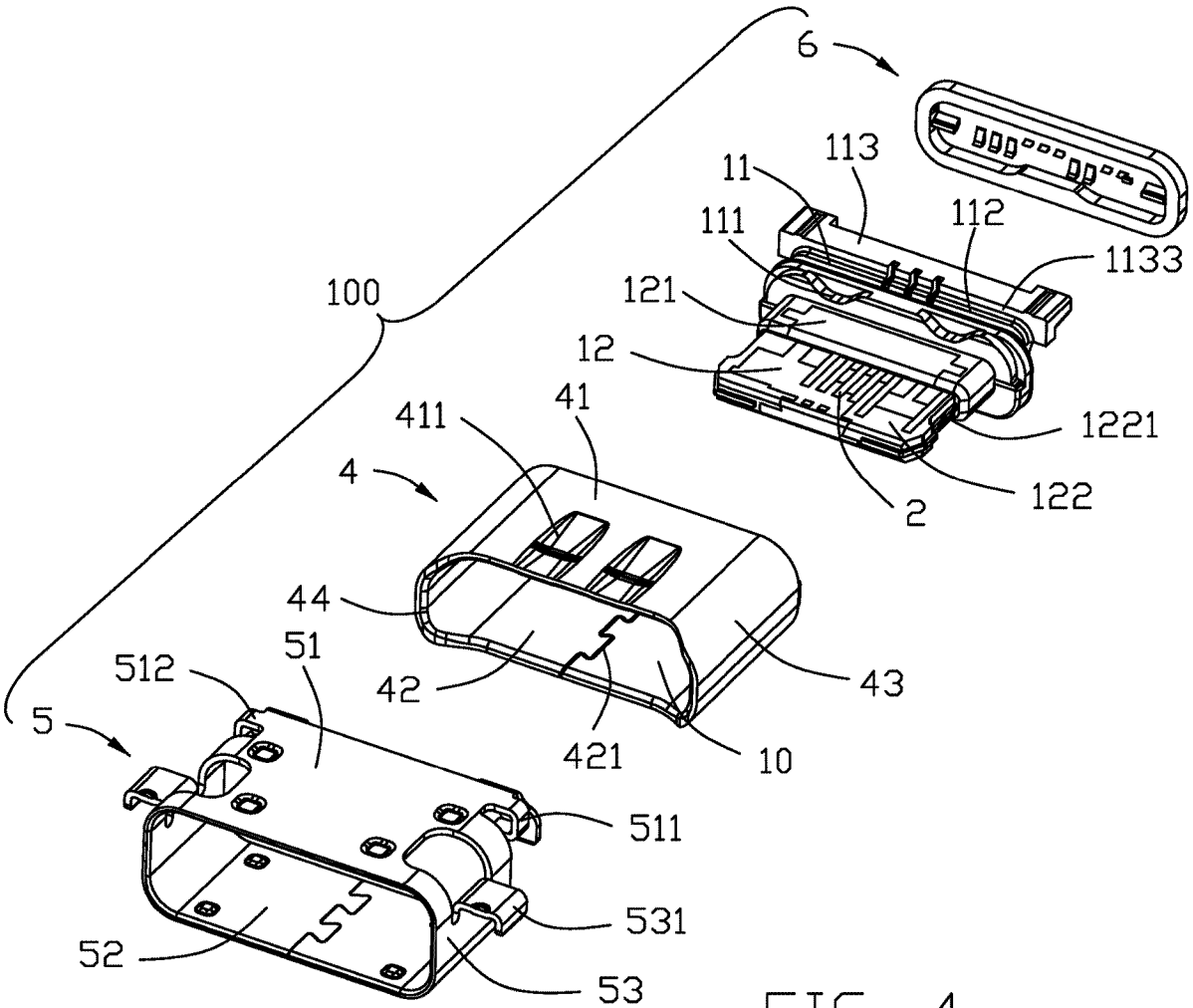
FIG. 4 is an exploded view of the electrical connector.
Figure 5:
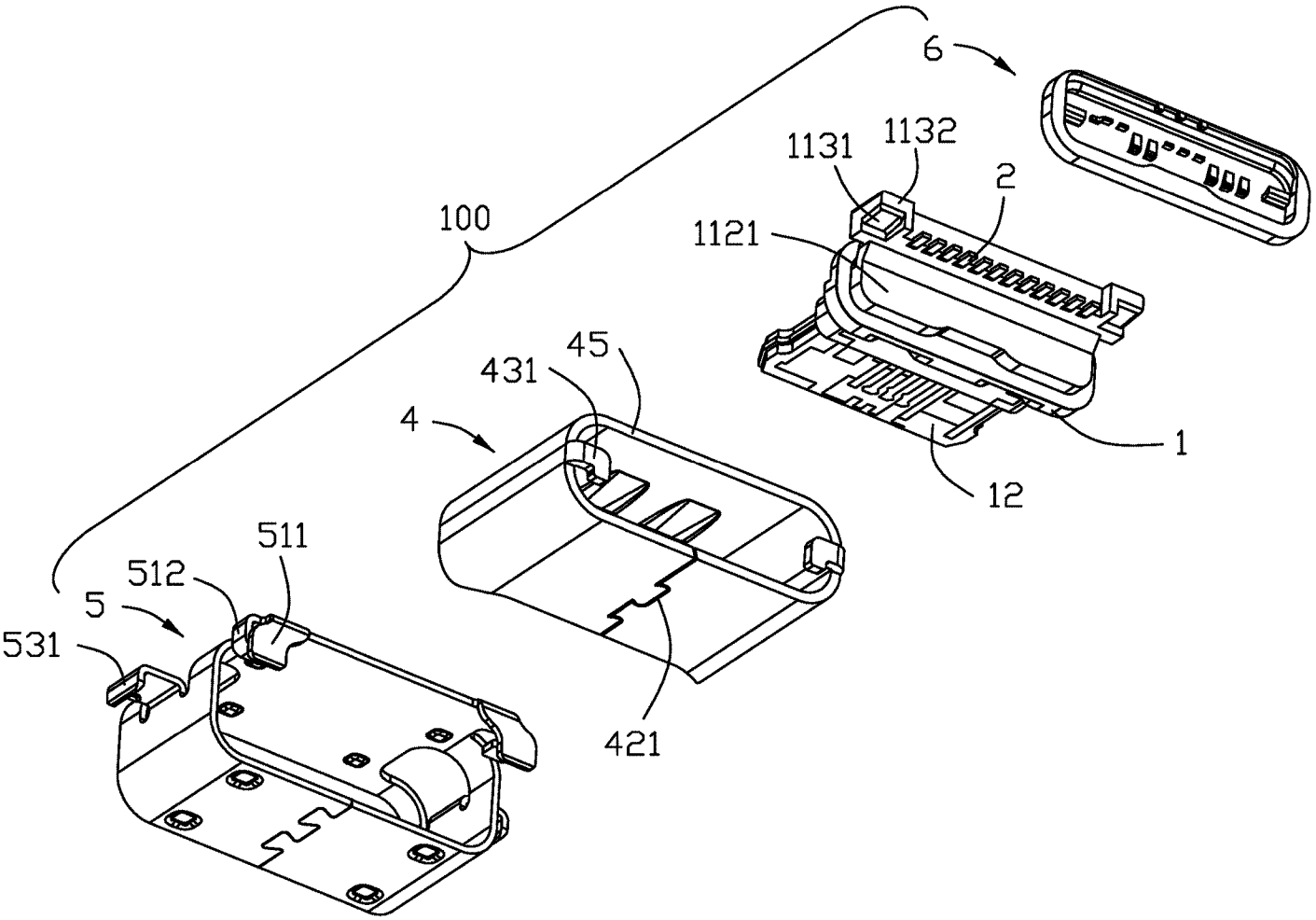
FIG. 5 is another exploded view of the electrical connector taken from FIG. 4.

Referring to FIGS. 3 to 8, the shielding shell 4 is formed by metal stamping. The shielding shell 4 includes an annular wall including a top wall 41, a bottom wall 42 opposite to the top wall 41 and a pair of lateral walls 43 connecting the top wall 41 and the bottom wall 42. The shielding shell 4 further includes a front edge 44 and an rear edge 45. One of the top wall 41 and the bottom wall 42 includes a pair of resisting tubers 411 protruding into the receiving room 10 and resisting against the resisting grooves 111 preventing the insulative housing 1 moving forwardly. In the embodiment, both the top wall 41 and the bottom wall 42 include the resisting tubers 411. The annular wall includes a riveted joint 421, i.e., the seamed structure. In the embodiment, the riveted joint 421 is located obliquely at the bottom wall 42. The riveted joint 421 is composed of a first inclining surface (confrontation edge) 4211 and a second inclining surface (confrontation edge) 4212 disposed in a thickness direction of the shielding shell 4. The angle of the first inclining surface 4211 and the second inclining surface 4212 with regard to the thickness direction of the shielding shell 4 is preferably below forth-five degrees. The first inclining surface 4211 and the second inclining surface 4212 have a number of dovetail structures in a flattening direction. Since the first inclining surface 4211 and the second inclining surface 4212 on both sides of the riveted joint 421 are obliquely arranged when the shielding shell 4 is riveted, the contacting area between the first inclining surface and the second inclining surface during riveting is relatively large. The overlapped portion of the shielding shell 4 in the thickness direction at the riveted joint 421 can minimize the gap at the riveted joint of the shielded shell 4 after riveting, so that the waterproof effect is better. Referring to FIG. 2, the lateral walls 43 include a pair of buckling tubers 431 bending inwardly and resisting against the rear surface 1121 of the sol 112 preventing the insulative housing moving rearward. The front edge 44 protrudes forwardly from a front end of the outer shell 5. The rear edge 45 resists against the front surface 1133 of the mounting portion 113 preventing the insulative housing moving forwardly.

Referring to FIGS. 1 to 5 and FIGS. 8 to 9, the outer shell 5 is affixed to the shielding shell 4 by welding. The outer shell 5 includes an upper wall 51, a lower wall 52 opposite to the upper wall 51 and a pair of side walls 53 connecting the upper wall 51 and the lower wall 52. The upper wall 51 includes a pair of first extending portions 511 bending downwardly and a pair of second extending portions 512 bending downwardly and then inwardly and located laterally from the first extending portions 511. The second extending portions 512 buckle with the buckling portions 1131 and the first extending portions 511 resist against the rear buckling surface 1132 preventing the insulative housing 1 moving rearward. The side walls 53 include a pair of affixed portions 531 fixing on a printed circuit board. In a preferred embodiment, the outer shell 5 may only include the lower wall 52 sealing the riveted joint 421 and the affixed portions 531 making a better waterproof effect.

The sealer 6 is liquid-molded on the sol 112 and integrated with the sol 112 making the sealer 6 and the rear surface 1121 in the same plane sealing the rear end of the electrical connector 100.

Figure 9A:
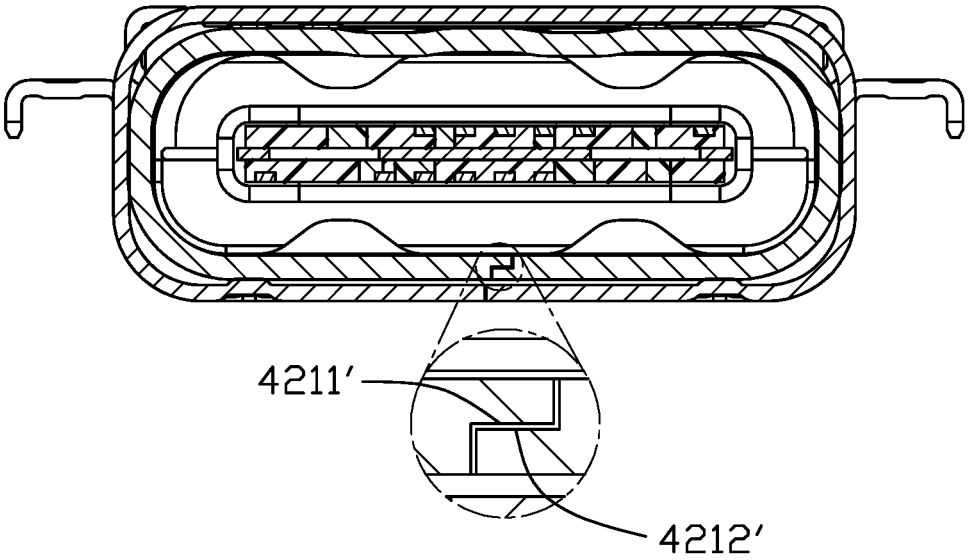
FIG. 9(A) shows the enlarged cross-sectional view of the riveted joint of another embodiment.

In the present invention, the riveted joint is designed to be obliquely arranged at the joint of the shield shell. So that the first inclining surface and the second inclining surface forming the riveted joint have a large contact area. When the shielding shell is riveted, the two are in contact with each other. Larger and easier to fit, and due to the overlapped part of the upper and lower shielding shells during riveting. The gap of the shielding shell after riveting can be made smaller, and the waterproof effect is better. After the shielding shell is riveted, a thick layer of plating (such as Sn) is electroplated and all the gaps are filled. This method uses in an ordinary riveted shielding shell. The advantage is low cost, no increase in the process, and a wide range of applications. FIG. 9(A) discloses another embodiment of the riveted joint wherein the inclining surfaces 4211 and 4212 are replaced with the complementary structures having an L-shaped confrontation edges 4211' and 4212' which are similar to the inclining surfaces 4211 and 4212 not only overlapping with each other in the thickness direction but also increase the contact area therebetween for minimizing leakage therebetween for better waterproofing. Notably, in a cross-sectional view the gap between the first confrontation edge and the second confrontation edge shows a slash/backslash configuration (FIG. 9) or a Z-shaped configuration (FIG. 9(A)).

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing comprising a base portion and a tongue portion extending forwardly from the base portion;

a plurality of conductive terminals affixed to the insulative housing;

a shielding shell enclosing the insulative housing for forming a receiving room and comprising an annular wall having a riveted joint;

a sealer; and an outer shell attached to the shielding shell; wherein the riveted joint is composed of a first inclining surface and a second inclining surface disposed in a thickness direction of the shielding shell;

the annular wall comprises a top wall, a bottom wall opposite to the top wall, and a pair of lateral side walls connecting the top wall and the bottom wall, and the riveted joint is disposed in the bottom wall;

the outer shell includes a lower wall sealing the riveted joint and a pair of affixed portions extending laterally from the lower wall and located outside of the lateral side walls;

the base portion comprises a sol located at a rear end thereof receiving the sealer, a rear surface of the sol and a rear surface of the sealer are in a same plane, and the lateral side walls comprise a pair of buckling tubers bending inwardly and resisting against the rear surface of the sol preventing the insulative housing moving rearward; and the base portion comprises a mounting portion located at a rear end of the sol and having a pair of buckling portions recessed downwardly and a rear buckling surface, the outer shell comprises an upper wall opposite to the lower wall, a pair of first extending portions bending downwardly from two sides of the upper wall, and a pair of second extending portions bending downwardly and then inwardly, the second extending portions buckle with the buckling portions, and the first extending portions resist against the rear buckling surface to prevent the insulative housing from moving rearward.

2. The electrical connector as claimed in claim 1, wherein the first inclining surface and the second inclining surface have a plurality of dovetail structures in a flattening direction.

3. The electrical connector as claimed in claim 1, wherein the base portion comprises a pair of resisting grooves, the shielding shell comprises a pair of resisting tubers protruding into the receiving room, and the resisting tubers resist against the resisting grooves preventing the insulative housing moving forwardly.

4. The electrical connector as claimed in claim 1, wherein the mounting portion protrudes upwardly and laterally beyond the sol, the mounting portion comprises a front surface higher than the sol, and a rear edge of the shielding shell resists against the front surface to prevent the insulative housing from moving forwardly.

5. The electrical connector as claimed in claim 1, wherein the outer shell and the shielding shell are fixed together by welding.

6. The electrical connector as claimed in claim 1, wherein the shielding shell is formed by metal stamping.

7. An electrical connector comprising:

an insulative housing comprising a base portion and a tongue portion extending forwardly from the base portion;

a plurality of conductive terminals affixed to the insulative housing; and a shielding shell enclosing the insulative housing for forming a receiving room and comprising an annular wall having a riveted joint along a seamed structure; wherein the riveted joint includes a first confrontation edge and a second confrontation edge not only intimately horizontally abutting against each other but also overlapped with each other in a thickness direction of the shielding shell at said riveted joint in a complementary manner for enlarging contacting areas therebetween.

8. The electrical connector as claimed in claim 7, wherein said first confrontation edge is an inclining surface and the second confrontation edge is another inclining surface.

9. The electrical connector as claimed in claim 7, wherein in a cross-sectional view, a gap between the first confrontation edge and the second confrontation edge is of a slash or a backslash configuration.

10. The electrical connector as claimed in claim 9, wherein an angle of said slash configuration or said backslash configuration with regard to the thickness direction is less than 45 degrees.

11. The electrical connector as claimed in claim 7, wherein said first confront edge and said second confrontation edge are of an L-shaped configuration coupled to each other.

12. The electrical connector as claimed in claim 7, wherein in a cross-sectional view, a gap between the first confrontation edge and the second confrontation edge is of a Z-shaped configuration.

* * * * *